United States Patent [19]

Iwasa et al.

[11] Patent Number: 4,631,848

[45] Date of Patent: Dec. 30, 1986

[54] ROTARY INDICATING DEVICE

[75] Inventors: Hiroki Iwasa, Aichi; Kyozo Ohmi, Anjyo; Tokuhiro Amano, Nagoya, all of Japan

[73] Assignee: Kabushiki Kaisha Tokai Rika Denki Seisakusho, Aichi, Japan

[21] Appl. No.: 736,632

[22] Filed: May 21, 1985

[30] Foreign Application Priority Data

May 23, 1984 [JP] Japan ..... 59-105381

[51] Int. Cl.[4] ..... A47F 1/06

[52] U.S. Cl. ..... 40/427; 272/8 D; 446/243; 40/495; 40/587; 40/591

[58] Field of Search ..... 40/427, 495, 587, 591, 40/340, 595; 272/8 D, 8 N; 446/244, 243, 245

[56] References Cited

U.S. PATENT DOCUMENTS

| | | | |
|---|---|---|---|
| 1,804,453 | 3/1931 | Basseches | 40/340 |
| 2,158,902 | 5/1939 | Gray | 446/243 |
| 2,432,896 | 12/1947 | Hotchner | 272/8 D |
| 2,482,947 | 9/1949 | Swarbrick | 40/427 |
| 2,583,275 | 1/1952 | Olson | 446/243 |
| 2,624,142 | 1/1953 | Sayre | 40/427 |
| 3,005,906 | 10/1961 | Buttler | 40/427 |
| 3,050,888 | 8/1962 | Myers et al. | 272/8 D |
| 3,624,958 | 12/1971 | Salayka | 446/243 |

FOREIGN PATENT DOCUMENTS

| | | | |
|---|---|---|---|
| 429042 | 5/1935 | United Kingdom | 40/454 |

*Primary Examiner*—Gene Mancene
*Assistant Examiner*—Wenceslao J. Contreras
*Attorney, Agent, or Firm*—Price, Gess & Ubell

[57] ABSTRACT

The disclosure relates to a rotary indicating device adaptable to, for example, wheel covers for motor vehicles. The device includes a rotary base member having, on its front or rear surface, a plurality of indication regions which respectively consist of completely the same desired images and arranged at equal angular intervals about a rotary axis of the rotary base member. When the rotary base member rotates at more than a predetermined rotational speed, an observer located at a predetermined position with respect to the device can view a distinct constant image, appearing at a predetermined position of the rotary base member, due to the after image phenomenon.

4 Claims, 6 Drawing Figures

ROTARY INDICATING DEVICE

BACKGROUND OF THE INVENTION

The present invention relates generally to a rotary indicating device in use, for example, for wheel covers of a motor vehicle, indication boards of advertising apparatus, ornamental elements for toys, and the like, and more particularly to a rotary indicating device which comprises a base member having an indication surface, the indication surface including indicating regions formed thereon and representing desired images such as pictures, letters, marks and the like, the indication region being able to be viewed by an observer as a distinct or definite image due to the after image phenomenon of an observer's eyes during the rotation of the base member.

Generally, the image formed on a rotary device is not able to be visually recognized by an observer as a distinct image during the rotation of the rotary device. It will be readily seen that if such an image applied on the rotary device could be visually recognized by the observer as a distinct image, it will produce an improved ornamental efficiency.

From the above viewpoint, there has been conventionally provided a rotary indicating device, namely a wheel cover in use for motor vehicles, in Japanese Utility Model Laid-open Publication No. 133923/1974. The above wheel cover comprises a cover body, and an ornamental disc relatively rotatably mounted on the front surface of the body. The ornamental disc has a shaft concentrically extending from the rear surface thereof. The shaft passes through and is relatively rotatably supported by a journal mounted on the central portion of the body, and has, at its rear portion positioned beside the rear surface of the body, a weight for preventing the ornamental disc from rotating together with the body. Therefore, the image formed on the ornamental disc may be maintained in a static manner with respect to the cover body rotating together with the wheel of the vehicle, so that the image can be visually recognized by the observer who sees the advancing vehicle.

The known wheel cover as described above, however, has a disadvantage in that it is complicated in construction.

In order to eliminate the above disadvantage, the present inventors have provided such a rotary indication device as shown in FIG. 5, which is described in Japanese patent Laid-open Publication No. 43490/1983.

Referring to FIG. 5, there is shown the rotary indicating device or wheel cover having, at its front surface as the indication surface, an indication region 2 representing an image or a pattern "A B C". The indication region 2 comprises a plurality of elongated reflection faces 3 which are respectively inclined in the same direction and also at the same angle with respect to a standard plane perpendicular to a rotary axis of the rotary base member. A observer located at a predetermined position with respect to the rotary device can visually recognize, during the rotation of the rotary indication device due to the after image phenomenon, the image "A B C" of the indication region taking a predetermined rotated position each rotation of the rotary member.

With the rotary indicating device as described above, there is no problem when the rotational speed thereof is relatively high. However, when the rotational speed of the indicating device is relatively low, the after image phenomenon is not effective so that each image to be received by the observer once each rotation of the rotary base member is recognized by the observer as a plurality of separated images, namely as a very obscure image, not as one static image. In other words, the image repeatedly appears and disappears.

SUMMARY OF THE INVENTION

It is therefore an essential object of the present invention to provide a rotary indicating device in which the image applied on the rotary base member thereof can be visually recognized as a more distinct static or moving image by the observer due to the after image phenomenon during the rotation of the base member even if the rotational speed of the base member is relatively low.

In accomplishing this and other objects, according to the present invention, there is provided a rotary indicating device which comprises a rotary base member having an indication surface, the indication surface including a plurality of indication regions respectively representing a desired same image and formed thereon at approximately equal angular intervals about a rotary axis of the rotary base, at an equal radial distance from the rotary axis and in the same orientation with respect to the rotary axis. Each indication region comprises a plurality of reflection faces. The reflection faces of each indication region are inclined in substantially the same direction with respect to the rotational axis and also at the same angle with respect to a standard plane perpendicular to the rotary axis, whereby, the reflection faces of each indication region reflect light toward the same direction at one rotated position.

With the rotary indicating device as described above, assuming now that the rotary indicating device has two indication regions representing completely the same images or patterns, the observer located at a predetermined position with respect to the rotary indicating device can see the image two times during each rotation of the base member. Furthermore, subsequently assuming that the rotary indicating device has five indication regions representing completely the same images, the observer can see the image five times during each rotation of the base member. Therefore, on the assumption that any of the devices according to the present invention and the prior art shown in FIG. 5 rotate at the same rotational speed, according to the present invention, the observer can visually recognize the image more distinctly two or five times as compared with the prior art. On the contrary to the above, in the case where the degree of definition of the image to be recognized by the observer is taken as the standard of the judgement, according to the present invention, the observer can recognize the image having the same distinctness as that of the prior art even if the base member is set at ½ or 1/5 of the rotational speed of the prior art base member.

With the present invention, the indication regions, and hence the reflection faces, are generally formed on the front surface of the base member. However, the reflection faces may be also formed on the rear surface of the base member. In this case, it is necessary that the base member is made from a thin transparent plate, and the reflection faces is treated so as to forwardly reflect the incident light.

Furthermore, the reflection faces can be formed flat or curved. In addition, the reflection faces may be composed of elongated faces extending in parallel relation to each other or fragmental faces scattered in the indication region.

BRIEF DESCRIPTION OF THE DRAWINGS

This and other objects and features of the present invention will become apparent from the following description taken in conjunction with the preferred embodiment thereof, with reference to the accompanying drawings, in which.

DETAILED DESCRIPTION OF THE INVENTION

Figure 1:
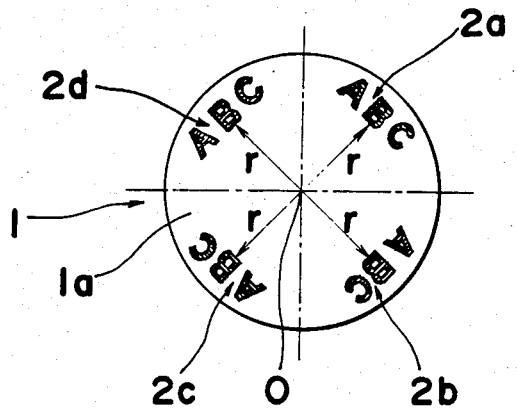
FIG. 1 is a front view illustrating a wheel cover for a motor vehicle as a rotary indicating device according to an embodiment of the present invention.

Before the description of the present invention proceeds, it is to be noted that like parts are designated by like reference numerals and symbols throughout several views of the accompanying drawings.

Referring to FIG. 1, there is shown a rotary indicating device or a wheel cover for motor vehicle to which the present invention is applied. As shown in FIG. 1, the wheel cover comprises a rotary base member 1 which has, at its front surface 1*a* , four indication regions 2*a*, 2*b*, 2*c* and 2*d*, each representing completely the same images or patterns, i.e. "A B C". The indication regions 2*a*, 2*b*, 2*c* and 2*d* are located on the front surface 1*a* of the rotary base member 1 at approximately equal angular intervals about a rotary axis O thereof, namely each ninety degrees, at an equal radial distance r from the rotary axis, and in the same orientation with respect to the rotary axis O.

The base member 1 of the wheel cover is preferably made with synthetic resin having a dark color with poor light reflection.

Figure 2:
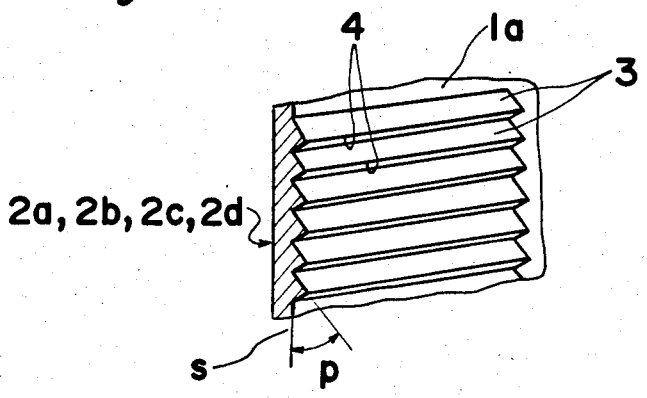
FIG. 2 is an enlarged fragmental view illustrating an indication region of the wheel cover shown in FIG. 1, FIGS. 3*a* and 3*b* are explanatory views of the wheel cover shown in FIG. 1 which shows the condition in which the observer can recognizes the image, i.e. "A B C" at the upper part of the wheel cover every rotational angle of ninety degree during the rotation of the wheel cover shown in FIG. 1.

As shown in FIG. 2, each indication region 2*a*, 2*b*, 2*c* and 2*d* formed by the image, i.e. "A B C" has a sawteeth cross-section and comprises a plurality of image elements which consist of flat reflection faces or facets 3 respectively extending in a predetermined direction in parallel relation to each other to collectively form "A B C", and non-reflection faces 4 also extending in said predetermined direction to connect the neibouring reflection faces 3 to each other. The reflection face 3 is covered be a reflection layer such as a metal plating layer. The reflection faces 3 are so designed as to be inclined in substantially in the same direction with respect to the rotary axis O and at the same appropriate angle P with respect to a standard plane S, i.e. the front surface 1*a*, perpendicular to the rotary axis O of the base member 1.

Figure 4:
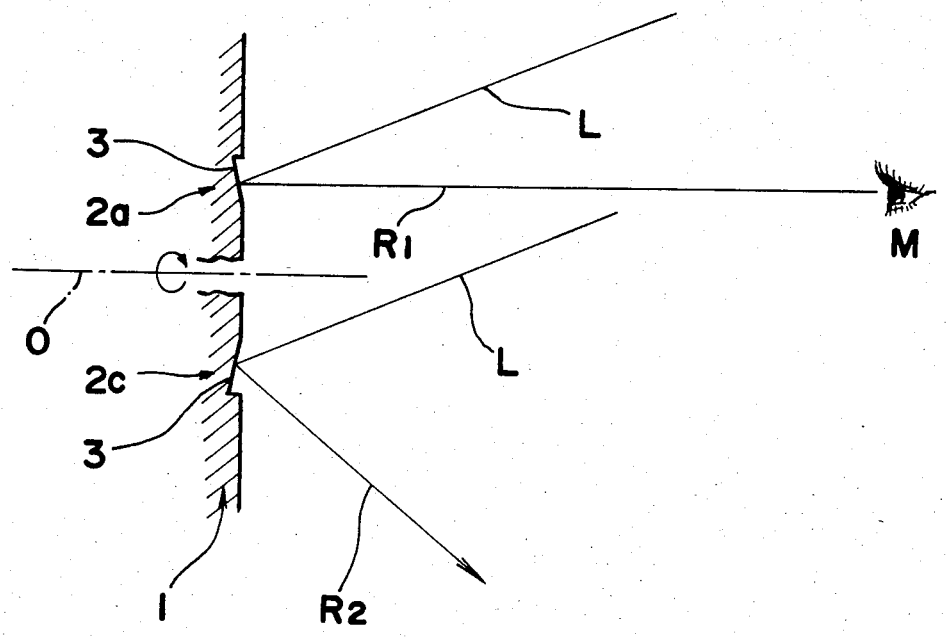
FIG. 4 is an explanatory view showing a condition in which the incident light is reflected at the indication regions taking the upper and lower position with respect to the rotary axis of the wheel cover shown in FIG. 1, and FIG. 5, which has been already described in the introductory part, is a front elevational view showing a prior art wheel cover.

Referring to FIG. 4 which diagramatically shows a section of the base member 1 at a rotated position, the first indication region 2*a* is located at the upper position, while the third indication region 2*c* is located at the lower position. Accordingly, the second and fourth indication regions 2*b* and 2*d* respectively take the right and left positions. Under the above condition, assuming now that the light L from a light source (not shown) is being projected toward the base member 1 and that an observer M is located at such a position with respect to the rotary indication device that the reflected light R1 reflected at a reflection faces 3 of the first indication region 2*a* taking the upper position is directed toward the eyes of the observer M, it is apparent that the reflected light R2 reflected at the reflection faces 3 of the third indication region 2*c* taking the lower position advances in the direction below the eyes of the observer M. Likewise, the reflected lights reflected at the reflection faces of the second and fourth indication regions 2*b* and 2*d* are also advance in the directions different from the eyes of the observer M. Accordingly, the observer M located at a predetermined position with respect to the wheel cover recognizes only the image of the first indication region 2*a*.

Figure 3A:
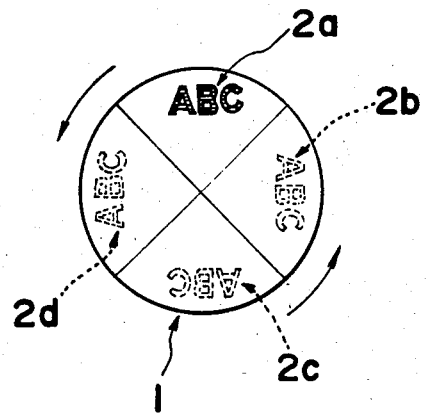
Figure 3B:
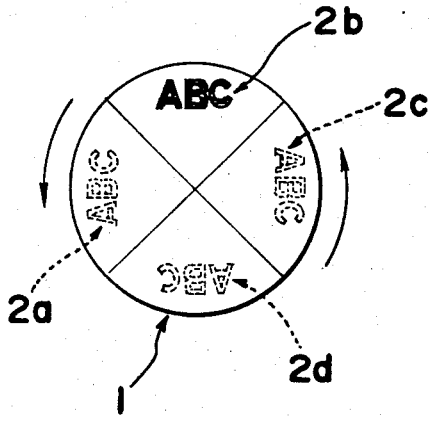

Referring to FIGS. 3*a* and 3*b* which respectively illustrate the front views of the rotary base member 1 at different rotated positions, the images, which can be viewed by the observer, are indicated by solid line, while the images, which can not be viewed by the observer, are indicated by dotted line. During the rotation of the rotary base member 1, when the rotary base member 1 takes the rotated position as shown in FIG. 3*a*, the observer can recognizes only the image of the indication region 2*a* of the base member 1, while, when the base member 1 rotates ninety degrees from the rotated position shown FIG. 3*a* to the subsequent rotated position shown in FIG. 3*b*, the second indication region 2*b* takes the upper position instead of the first indication region 2*a*, resulting in that the observer can recognizes the image of the second indication region 2*b*. Thus, the observer can recognize in turn the images of the indication regions appearing at the upper position of the base member 1 during each rotation of ninety degrees of the wheel cover. Meanwhile, as previously described, the images of all indication regions 2*a*, 2*b*, 2*c* and 2*d* are completely the same, and arranged on the front surface 1*a* of the base member 1 at approximately equal angular intervals about the rotary axis O, at an equal radial distance r from the rotary axis O and in the same orientation with respect to the rotary axis O. Therefore, when the rotational speed of the base member 1 exceeds a predetermined value, the observer can recognize the images appearing at the upper position of the base member 1 as a single static or moving image due to the after image phenomenon.

The inventors of the present invention have carried out an experiment using models similar to the wheel covers and obtained the following results.

Figure 5:
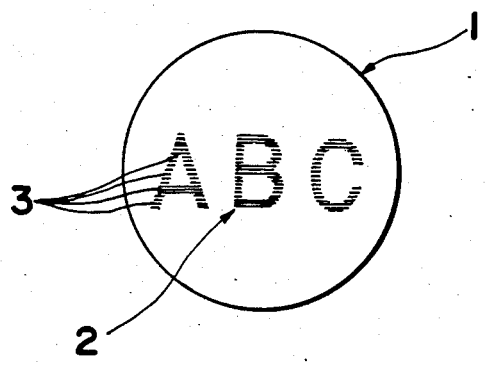
Fig. 5 PRIOR ART

In case of using the model of the prior art wheel cover shown in FIG. 5, the observer can view a single static image due to the after image phenomenon when the rotational speed of the wheel cover exceeds approximately 300 rpm (approximately 40 km/h). On the contrary, in the case of using the model of the wheel cover according to the embodiment of the present invention, the observer can view a single static image when the rotational speed of the wheel cover exceeds 300/4 rpm (10 km/h).

Although the present invention has been fully described by way of example with reference to the accompanying drawings, it is to be noted here that various changes and modifications will be apparent to those skilled in the art. For example, each reflection face of the rotary indicating device can be composed of a curved face which curves with respect to an imaginary axis extending parallel thereto. According to this modification, since the incident lights directed toward the rotary base member are reflected at the curved reflection back in the various directions over a certain range of angle. Thus, even if the observer and the light source respectively take different positions with respect to the rotary base member, the image formed on the rotary base member can be visually recognized by the observer. Therefore, unless otherwise such changes and modifications depart from the scope of the present invention, they should be construed as included therein.

What is claimed is:

1. A rotary indicating device which comprises a rotary base member having an indication surface, the indication surface including a plurality of indication regions each respectively representing the same images and formed thereon at approximately equal angular intervals about a rotary axis of said rotary base, at an equal radial distance from the rotary axis and in the same orientation with respect to the rotary axis, each indication region comprising a plurality of reflection faces arranged across the surface of the base member, the reflection faces of each indication region being inclined in substantially the same direction with respect to the rotary axis and also at the same angle with respect to the rotary axis and also at the same angle with respect to a standard plane perpendicular to the rotary axis, whereby, the reflection faces of each indication region reflects incident light toward the same direction at one rotated position.

2. In a wheel cover for an automobile the improvement comprising:

a rotary base member of a dark color synthetic resin material; and a plurality of separate indicating surfaces spaced about the wheel cover, each surface providing an identical image and each indication surface being positioned at approximately equal distances from the rotary axis of the wheel cover and including a plurality of elongated rectangular facets of a set pitch and a fixed angular position provided on the surface of the base member and extending traversely to a plane containing the rotary axis to collectively cooperate in forming the image, the rectangular facets consisting of only a metal plating layer to provide a reflection surface, wherein rotation of the wheel cover will cause a composite image of the identical images to be reflected from and sequentially projected to an observer.

3. A rotary indicating device as claimed in claim 1, the reflection faces are respectively composed of elongated faces extending in a predetermined direction.

4. A rotary indicating device as claimed in claim 1, wherein the rotary base member is made with synthetic resin having a dark color with poor light reflection.

* * * * *